US006126813A

United States Patent [19]

Fersing et al.

[11] Patent Number: 6,126,813

[45] Date of Patent: Oct. 3, 2000

[54] METHOD AND APPARATUS FOR SELECTIVE VAPORIZATION OF HYDROCARBON LOADS IN CATALYTIC CRACKING

[75] Inventors: Marc Fersing, Bergues; Mariano Del Pozo, le Havre, both of France

[73] Assignee: Total Raffinage Distribution S.A., Puteaux, France

[21] Appl. No.: 09/176,771

[22] Filed: Oct. 22, 1998

[30] Foreign Application Priority Data

Oct. 24, 1997 [FR] France ..... 97 13363

[51] Int. Cl.[7] ..... C10G 35/00

[52] U.S. Cl. ..... 208/164; 208/120; 208/113; 208/127

[58] Field of Search ..... 208/113, 157, 208/120, 164, 127

[56] References Cited

U.S. PATENT DOCUMENTS

| | | | |
|---|---|---|---|
| 4,332,674 | 6/1982 | Dean et al. | 208/120 |
| 5,108,583 | 4/1992 | Keon | 288/157 |
| 5,318,691 | 6/1994 | Muldowney | 208/113 |

FOREIGN PATENT DOCUMENTS

| | | |
|---|---|---|
| 208 609 | 1/1987 | European Pat. Off. . |
| 209 442 | 1/1987 | European Pat. Off. . |
| 2 621 322 | 4/1989 | European Pat. Off. . |
| 382 289 | 8/1990 | European Pat. Off. . |
| 485 259 | 5/1992 | European Pat. Off. . |

*Primary Examiner*—Helane E. Myers
*Attorney, Agent, or Firm*—Sughrue, Mion, Zinn Macpeak & Seas, PLLC

[57] ABSTRACT

The invention relates to a hydrocarbon catalytic cracking method in the presence of a catalyst in fluidized phase, within a tubular type reactor (1) containing an injection area.

According to the invention, a substantial part of the load to be cracked is introduced into the injection area using at least one means of injection (3) of such load against the flow, in relation to the direction of flow of the catalyst grains, and a substantial part of the load to be cracked is simultaneously introduced in the same area using at least one means of injection (2) of such load in direction of the flow in relation to the direction of flow of the catalyst grains.

15 Claims, 3 Drawing Sheets

METHOD AND APPARATUS FOR SELECTIVE VAPORIZATION OF HYDROCARBON LOADS IN CATALYTIC CRACKING

This invention relates to a hydrocarbon catalytic cracking method and apparatus in the presence of a catalyst in fluidized phase. More particularly its objective is a method and apparatus that allow for a good vaporization as well as a good conversion of hydrocarbon loads treated in the cracking reactor.

As known in the industry, the oil industry resorts to conversion methods of heavy hydrocarbon loads, methods in which hydrocarbon molecules with a high molecular weight and high boiling point are split up into smaller molecules, that can boil in lower temperature ranges, suitable for the sought use.

In this field, the most widely spread method is currently the method called the Fluid Catalytic Cracking (hence the name FCC). In this type of method, the hydrocarbon load, pulverized into fines droplets, is put in contact at high temperature with cracking catalyst grains that circulate in the reactor in the form of a diluted fluidized bed, meaning in suspension in the midst of a gaseous fluid insuring their transportation. A vaporization of the load then takes place, followed by a cracking of the hydrocarbon molecules on the active sites of the catalyst. After having thereby reached the desired range of molecular weight, with a corresponding lowering of the boiling points, the product obtained is separated from the catalyst's grains; the latter are stripped in order to recuperate the hydrocarbons acted upon, then regenerated by combustion of the formed coke, and lastly put back in contact with the load to be cracked.

The reactors used are generally tubular type vertical reactors, in which the catalyst travels following an essentially upward flow (the reactor is then called "riser") or following an essentially downward flow (the reactor is then called "dropper" or "downer").

It has been proved that one of the key factors of the catalytic cracking method relates to the quality of the vaporization of the hydrocarbon load to be cracked when in contact with the hot regenerated catalyst grains, in the injection area of such load. Since the catalytic cracking reaction takes place in a gaseous state, the temperature at which the grains of the catalyst are mixed with the load must therefore be such that it will allow for a complete and instantaneous vaporization of this load. Therefore, this mixing temperature must be greater than or equal to the vaporization temperature of the heaviest hydrocarbons present in the load.

As far as the optimal temperature of the catalytic cracking reaction is concerned, it depends on the chemical composition of the load, the type of catalyst being used, and the nature of the desired conversion products (gasolines or oils). It is usually between 450 and 550° C. For the conversion to take place in good conditions, the load must therefore be completely vaporizable in this temperature range. This constraint therefore limits the FCC method to the conversion of relatively light loads.

Indeed, major problems arise when we want to convert heavier loads: these loads often contain hydrocarbons whose boiling point is greater than the optimal reaction temperature. This is particularly the case for loads such as residues: they have the particularity of being rich in high molecular weight and strong metal content compounds, such as, among others, asphaltenes. They boil at particularly high temperatures and therefore are difficult to vaporize under optimal cracking reaction conditions. Two alternatives are then possible:

either the reactor's temperature must be adjusted to the optimal temperature of the reaction; as the mixture's temperature is below the vaporization temperatures of the heavier hydrocarbons, the load is only partially vaporized, which produces an increased deposit of coke on the surface of the catalyst, through a collision of the catalyst grains with the non vaporized droplets of the load. This results in a lesser conversion of the light products of the load, as the liquid hydrocarbons are not converted, and the catalyst, excessively coked, is only partially deactivated.

or the reactor's temperature must be adjusted to a higher value, in order to insure a complete vaporization of the load; the reaction temperature is then too high when compared to its optimal value, and it results in an increase of the thermal cracking process, to the detriment of the catalytic cracking reactions: there is an overcracking of the injected hydrocarbons, which is translated by an increased production of coke and hydrocarbons that are too light and non amenable to beneficiation, along with a reduction of the production of the sought intermediary products.

In order to solve the technical problems tied to the catalytic cracking of heavy oil loads, a certain number of solutions have already been considered:

U.S. Pat. No. 4,332,674 (Mauléon, Dean and Pfeiffer) proposes a method where the mixing temperature is increased through the heat carried by a double regeneration system of the catalyst; in this type of process, the load is indeed correctly vaporized, but, the reaction temperature is too high, which causes the apparition of an overcracking and its negative consequences as far as the performance and selectivity of sought products is concerned.

in U.S. Pat. No. EP 0,208,609, the petitioner proposed an adequate means of controlling the temperature in the cracking reactor: immediately after the injection and the instantaneous vaporization of the load at a high mixing temperature, the catalytic reaction temperature is reduced to its optimal value by introducing an auxiliary cooling fluid at an appropriate rate and temperature. In this way, the catalytic cracking reaction can continue under these softer conditions that are more independent of the mixing temperature. However, the vaporization method used has the fault of not being absolutely selective, in that is does not take into account the disparity of the hydrocarbons present in the load to be cracked. Indeed, if the mixing temperature is optimal for the vaporization of the load's heavier compounds, it is nevertheless too high for the lighter compounds also present in this load; these may then run the risk of overcracking in the time frame that separates the injection of the load and that of the auxiliary cooling fluid.

lastly, in patent EP 0,209,442, the petitioner recommends introducing the load under the form of a flow of fine droplets injected against the flow of catalyst grains. This injection method allows for a better vaporization of the load's droplets, since their counter current introduction only allows them to meet a flow of regenerated hot catalyst at a constant temperature that is close to its temperature upon introduction in the reactor. However, there also, the vaporization conditions lack selectivity, as they do not take into account the diversity of the hydrocarbons present in the load. Furthermore, the injection of the load against the flow of the catalyst results in difficulties tied in particular to the startup of the catalytic cracking unit: during the particularly critical period when the counter current injection is started, we do indeed note a risk that the catalyst circulation may stop or the direction of the circulation may be reversed for all or part of the catalyst grain flow (meaning these grains return in the direction of the regenerator), which, in all cases, can result in a serious malfunction of the unit.

Therefore, the previous art does not fully resolve the problem of catalytic cracking of heavy loads in a satisfactory manner. This is why the petitioner has pursued her work in this field, and she has perfected a method and apparatus which will allow the previously mentioned inconveniences to be remedied.

Thus, the invention's objective is to propose a catalytic cracking apparatus in which the injection area of the load to be cracked contains a dual injection system, consisting of injectors that allow for the introduction of the load, some against and some with the flow, in relation to the direction of the flow of the catalyst grains. The invention also relates to the particularly advantageous use of such an apparatus.

For this purpose, the objective of this invention is a hydrocarbon catalytic cracking method in the presence of a catalyst in a fluidized phase, in a tubular type reactor with a flow that is essentially upward or downward, containing an injection area of the load to be cracked, and this method is characterized by the fact that a substantial portion of the load to be cracked is introduced into the reactor's injection area by at least one means of injection of such load against the flow in relation to the direction of flow of the catalyst grains, and by the fact that a substantial portion of the load to be cracked is introduced simultaneously in the same area by at least one injection means of such load in the same direction as the flow of the catalyst grains.

In this definition, as in the remainder of this description and in the attached claims, the notion of co-current and counter-current are defined in relation to the overall direction of flow of the catalyst grains and the products cracked along the catalytic cracking reactor.

Furthermore, the petitioner has designed a particularly advantageous method of operation of the process as it relates to the invention, in which the counter-current injected load contains heavy hydrocarbons whereas the co-current injected load is lighter.

In such a method, the heavier hydrocarbons are injected against the direction of flow of the catalyst, which allows them to benefit from improved vaporization conditions brought about by this mode of injection. As far as the lighter hydrocarbons are concerned, easily vaporizable, they are injected in less severe conditions, which limits the risk of overcracking of these hydrocarbons. Thus, both fractions of the load to be cracked are injected in a way that is entirely adapted to their respective natures, under optimal conditions, which selectively ensures their complete vaporization. As a result, there is a reduction of the coking due to the overcracking phenomenon, or to the presence of heavy non vaporized load drops.

Furthermore, this method has proved to be an original method of temperature control in the cracking reactor. Indeed, while the catalyst's temperature must be particularly high upstream of the injection area in order to ensure the vaporization of the heaviest load injected against the flow, the cracking reaction must thereafter continue under softer conditions in order to avoid any overcracking and its harmful consequences. It is indeed possible lower this reaction temperature to its optimal value by adequately adjusting the temperature of the co-current injected load since this load, lighter than the counter-current injected load, does not require such high vaporization temperatures. Thanks to this control, we can reduce the risk of overproduction of coke and very light hydrocarbons observed when using an apparatus such as the one described in U.S. Pat. No. 4,332,674, and therefore improve the selectivity of the conversion in favor of the sought intermediary products (gasolines, oils).

In general, the invention's procedure allows one to access a better selectivity for the conversion of the load. Indeed, the heaviest hydrocarbons are subjected to a vaporization and to a first stage of thermal cracking under severe conditions, whereas the lighter hydrocarbons are subjected to softer catalytic vaporization and cracking conditions that are better adapted to their nature. In this way we can overcome one of the primary difficulties concerning catalytic cracking, namely ensuring an effective cracking of the heaviest molecules while avoiding an overcracking of the lightest molecules. This is why this method has proved particularly appropriate for the operating systems in which we seek first and foremost to control the selectivity of the catalytic cracking reaction in favor of a given intermediary fraction as is the case, for example, in "maximum gas-oil operation".

At the same time, with this method, it is possible to avoid the overcoking of the catalyst, which is translated by better conversion rates of the load to be cracked. This results in an easier regeneration of the catalyst by shortening its residence time within the regenerator (or regenerators) and reducing the risk of encountering hot spots which can damage the catalyst and the catalytic cracking unit.

Lastly, the method consistent with the invention, makes it possible to eliminate the difficulties tied to the start-up of a catalytic cracking unit in which some load is injected against the flow. Indeed, thanks to the dual injection system involved, we can, in a first stage, inject the load to be cracked in the same flow direction as that of the catalytic phase, especially during the most critical phase of the start-up (phase during which the total pressure within the unit is quite different from that noted when this unit operates in a productive and stable run). Then, when the circulation of the catalyst is well established, we can, progressively or not, start the counter-current injection of the load to be cracked, while reducing if necessary the co-current injection flow.

Therefore, the objective of this invention is a start-up method of a hydrocarbon catalyst cracking unit in the presence of the catalyst in a fluidized phase, in a tubular type reactor with a flow that is essentially upward or downward, with this method being characterized by the fact that, upon the start-up of the unit, a load is first injected in the same direction of flow as that of the catalytic phase, then courant-current thereto, while, at the same time, maintaining the co-current injection, possibly with a progressive reduction of its flow.

Such a method therefore makes it possible to benefit from the undeniable performances tied to the counter-current injection of the load, while attaining a better control of the circulation of the catalyst.

The invention also relates to the apparatuses that allow for an implementation of the methods explained above.

For this purpose, this invention's objective is a hydrocarbon catalytic cracking apparatus in the presence of a catalyst in fluidized phase, in a tubular type reactor whose flow is essentially upward or downward, equipped with means of injection of the load to be cracked. This apparatus is characterized by the fact that the injection means of the load to be cracked consist of:

at least one means of hydrocarbon counter-current injection in relation to the direction of flow of the catalyst grains, at least one means of hydrocarbon co-current injection in relation to the direction of flow of the catalyst grains, such means being arranged in one same hydrocarbon injection and mixing area in the catalyst's flow.

Thanks to this apparatus, one has better control over the catalytic cracking process and it actually becomes possible, for a given load to be cracked, to subject it to a simple fractionation before selectively injecting the heaviest part against the flow, and the lightest part with the flow. Thus, only the heaviest hydrocarbons will, in a first phase, undergo a severe thermal cracking, whereas the lighter products will be cracked in a softer way. It also becomes possible to initiate the selective recycling of certain effluents of the catalytic cracking reaction: the residue type effluents can be re-injected against the flow, whereas the lighter distillate type residues can be re-injected with the flow. All this makes it possible to enhance even more the conversion of the load to be cracked, in a manner that is both more complete (a better exhaustion of this load) and more selective (orientation of the conversion in favor of the sought intermediary products).

Other advantages of this invention will emerge following this description.

In the invention's method, portions of the load to be cracked are simultaneously introduced into the cracking reactor both against the flow and with the flow in relation to the direction of flow of the catalyst grains.

Advantageously, two types of hydrocarbon loads are converted simultaneously in the catalytic cracking reactor, with the heavier load being injected against the flow in relation to the direction of flow of the catalyst grains, whereas the lighter load is injected with the flow in relation to the direction of such flow.

According to one particularly advantageous mode of operation, the load injected against the flow can contain a considerable amount of compounds of which the boiling point is greater than or equal to the mixing temperature. The preferred loads are those that contain fractions that normally boil up to 700° C. and higher, and can contain high contents of asphaltene and show a Conradson carbon content attaining up to 4% and higher. It can, in particular, be heavy distillates, residues of atmospheric distillation, even residues form distillation under vacuum. Should the occasion arise, these loads can have received a previous treatment such as, for example, a hydrotreatment in the presence of a cobalt/molybdenum type catalyst. In order to make their injection easier, these loads can, if necessary, be diluted by lighter fractions, which can include the intermediary fractions produced from the catalytic cracking themselves that have been recycled, such as, for example, light cycle oils (LCO) or heavy cycle oils (HCO).

At the same time, the load that is injected with the flow is preferably of a lighter nature than that injected against the flow. It can advantageously contain a considerable amount of compounds whose boiling point is lesser than or equal to the mixing temperature. It could be petroleum fractions such as the conventional catalytic cracking loads, such as, for example, distillates and/or gas oils resulting from the distillation under vacuum, viscosity breaking distillates and/or gas oils, or even possibly deasphalted residues. It may also be lighter fractions such as gas oils stemming from the atmospheric distillation, if the refinery overproduces this type of fraction.

One can also adequately control the quantities of both injected loads, in particular by adjusting the ratio of the quantity of hydrocarbons injected with the flow and that injected against the flow to the total content in heavy compounds of the load that is to be cracked.

The loads injected against the flow and with the flow can be from a totally different origin or, on the contrary may stem from one single original load.

Indeed, for a given load to be cracked, is can advantageously, prior to its injection, be subjected to a primary fractionation, with preferably a fraction point that corresponds with the mixing temperature within the cracking reactor. The heaviest fraction is then injected against the flow, whereas the lighter fraction is injected with the flow. As a result, even when there is only one load to crack, the apparatus that is the object of this invention seems to be extremely advantageous, since it makes it possible to optimize the cracking of such load in a much finer manner and with an enhanced conversion rate when compared with what the methods described in the preceding art could allow.

A particularly advantageous variable of the method of this invention consists in adequately recycling all or part of the less amenable to beneficiation products recuperated as a result of the fractionation of the catalytic cracking effluents. Thus, the load that is injected against the flow may contain slurry type recycle residues, alone or mixed with the fresh load. In the same way, the load that is injected with the flow may contain HCO or LCO type recycle residues, alone or mixed with the fresh load.

Indeed, the slurry (residue resulting from the fractionation of the catalytic cracking effluents) is a very heavy product, rich in polyaromatic compounds, that contains a fair amount of catalytic fines (powder derived from the erosion of the grains), which makes it a product that is generally hard to valorize. Therefore, it seems particularly desirable to recycle it as a heavy load to be converted, which also has the advantage of re-introducing the fines in the circuit of the catalyst grains, thus avoiding their outflow from the unit.

As far as the gas oils and distillates stemming from the catalytic cracking are concerned, respectively the LCO and HCO, these are also products that are not very amenable to beneficiation because they are rich in sulfur and in aromatic compounds, and are usually used as diluents of heavy fuels. This is why it may be wise to recycle them, especially since it makes it possible to increase the production rate of gasolines of the catalytic cracking unit.

The apparatus which is the objective of this invention advantageously consists of one or several injectors which make it possible to introduce hydrocarbons against the flow in relation to the direction of the flow of the catalyst grains and one or several injectors that make it possible to introduce hydrocarbons with the flow in relation to the direction of the flow of catalyst grains. These two types of injectors may or may not be identical, and they may consist of any known means allowing for the introduction of a liquid hydrocarbon load in a catalytic cracking reactor.

For each of these two types of injection (namely counter-current and co-current), the injector (or injectors) are arranged so as to ensure a uniform distribution of the corresponding load on the reactor section. Preferably, for each injection mode, there will be two to ten injectors arranged in a circle, meaning evenly spaced around the perimeter of a same section of the tubular reactor. Advantageously, the ratio of number of counter-current injectors to that of co-current injectors can be determined in relation to the average residue content in the loads that are to be converted.

The injector (or injectors) pointing in the direction of the flow are such that they make it possible to introduce hydrocarbons according to a direction that has an angle of 0 to 90 degrees in relation to the direction of the flow of catalyst grains. The injector (or injectors) pointing against the direction of the flow are such that they make it possible to introduce hydrocarbons according to a direction that has an angle of 95 to 170 degrees in relation to the direction of the flow of such grains.

At least as far as the counter-current injection is concerned, it is important to use injectors that will pulverize the load into droplets with a diameter of less than 200 microns, or even less than 100 microns; this atomization of the load makes the vaporization in the reactor easier, which is that much more important as the load that is injected against the flow is heavy and therefore difficult to vaporize. Therefore, the pulverization apparatuses that are necessary are of a type that is well known to the specialists; preferably, for example, injectors such as those described in patent EP 0,312,428, deposited on behalf of the petitioner will be used.

According to the invention, both types of injectors must be placed in the same hydrocarbon injection and mixing area in the catalyst flow; in practice, this means that they are placed either on the same level as the reactor, or in levels that are different but sufficiently close.

In the case where the two types of injectors are on the same level, there is only one single injection section, consisting of injectors pointing against the flow and injectors pointing in the same direction as the flow; preferably, these two types of injectors can be arranged in a circle, alternately, on the circumference of the reactor.

However, in the case where the two types of injectors are placed on different levels, there are two successive injection sections, one consisting of one or several injectors pointing against the flow and the other consisting of one or several injectors pointing in the direction of the flow. Such sections are spaced at a maximum distance equal to two times the average diameter of the reactor in the injection area of the load. In creating such an apparatus, many alternatives are possible. In particular, the injectors pointing in the direction of the flow can be placed upstream, or downstream, from those pointing against the flow. In the case where the two sections consist of injectors arranged in a circle, these two circles of injectors can be placed strictly one on top of the other, but preferably they will be staggered.

The hydrocarbon injection area in the reactor, will be at a level such that it not only ensures a good thermal exchange between the catalyst and the loads that are introduced but also an instantaneous vaporization of the latter. In practice, this injection area will be positioned in the reactor in such a way that the flow of catalyst grains penetrating such area will be a homogenous catalyst flow in a diluted fluidized phase, meaning that has a density that is preferably between 15 and 700 kg/m$^2$. The linear speed of this flow will preferably be between 0.01 and 10 m/s.

Furthermore, this injection area can be included in a mixing chamber whose configuration allows for a homogenous and favorable flow of the catalyst's mixture and the injected hydrocarbons, whether the reactor be a "riser" or "downer" type reactor. In the case of a "downer" type reactor, it may for example be a mixing chamber such as the one described in the request for French patent No 96 11369, deposited on Sep. 18, 1996 in the name of the petitioner.

In general, the temperatures of the injected loads will be between 70 and 450° C., under a relative pressure of $0.7.10^5$ to $3.5.10^5$ Pa. The temperature of the load injected against the flow is optimized in order to make possible its pulverization into fine droplets, this is that much more difficult since this load is heavy and viscous. As far as the load that is injected in the direction of the flow is concerned, its temperature will preferably be calculated so as to lower the reaction temperature downstream of the injection area to an optimal value. The final temperature of the reaction area that has been cooled in this manner can for example be in the 500° C. range, but must be greater than the dewpoint of the heaviest hydrocarbons that are present.

The catalyst grains flow will be introduced in the reaction section at a temperature that is preferably between 600 and 950° C., depending on the nature of the loads to be cracked.

Within the scope of this invention, it does not seem necessary to mention the type of catalyst used, nor the various fluids and catalyst fluidization apparatuses, which is known data to the person skilled in the art.

The various forms of implementation of the invention mentioned above will be described hereafter in more detail, referring to the attached illustrations. Their purpose is merely to illustrate the invention and therefore have no restricted character as the method that is the objective of this invention may be implemented according to many variables.

On these illustrations:

FIG. 1*a* is a diagrammatic sectional view of a cracking reactor, according to I—I of FIG. 2;

FIGS. 1*b*, 1*c*, and 1*d* schematically illustrate various configurations of injectors of the load to be cracked within the reactor.

Figure 1A:
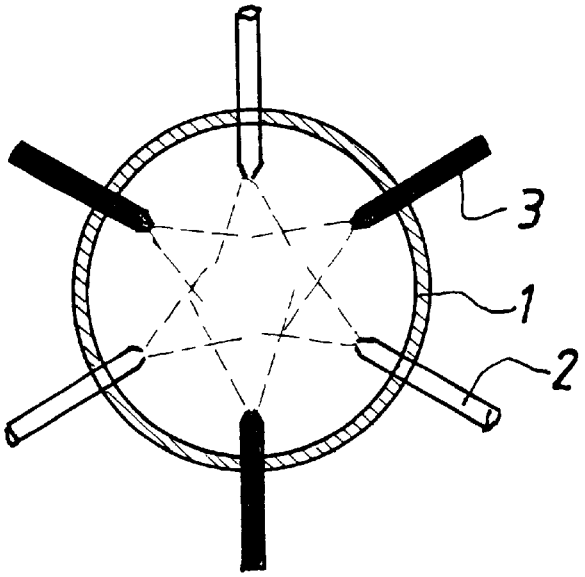

First we will refer to FIGS. 1*a* through 1*d*, on which the similar organs are designated by the same reference numbers. These figures illustrate examples of the configuration of the injection area in catalytic cracking devices that are in accordance with the invention.

Each apparatus consists of six load injectors, located on side 1 of a "riser" type reactor: three of them point in the direction of the flow (injectors 2), and the other three point against the flow (injectors 3). These injectors are placed alternately on side 1 of the "riser" type reactor: injectors 2 in the direction of the flow are represented in white, and those pointing against the flow 3 are in black.

Figure 1B:
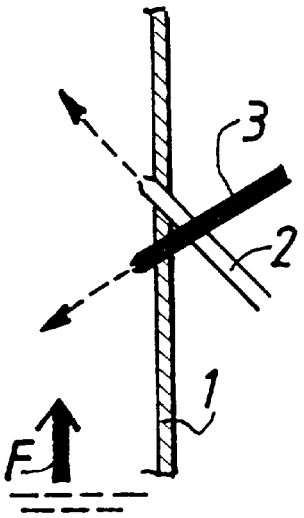
Figure 1C:
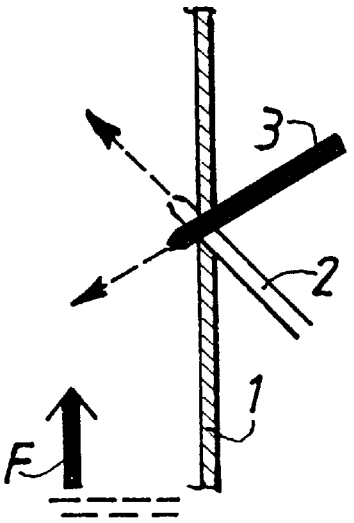
Figure 1D:
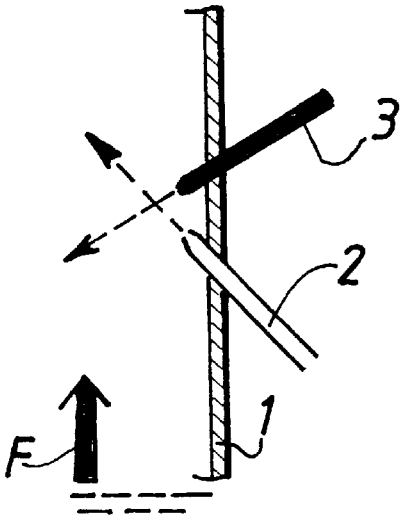

FIG. 1*a* represents the injectors seen from above, whereas FIGS. 1*b*, 1*c*, and 1*d* illustrate various possible positions relative of the two types of injectors on side 1 of the reactor. The F arrows represent the direction of the circulation of the catalyst. On FIG. 1*b*, the counter-current injectors 3 are positioned slightly upstream from those in the direction of the flow 2. On FIG. 1*c*, the two types of injectors are on the same level. On FIG. 1*d*, the counter-current injectors 3 are positioned slightly downstream from those in the direction of the flow 2. For reasons of simplification, only two injectors (one of each type) are represented and are positioned strictly one on top of the other, however, in practice, it seems more favorable to have several injectors of each type, positioned in a circle and offset from each other, so that, when seen from above, we have the positioning of FIG. 1*a*.

Figure 2:
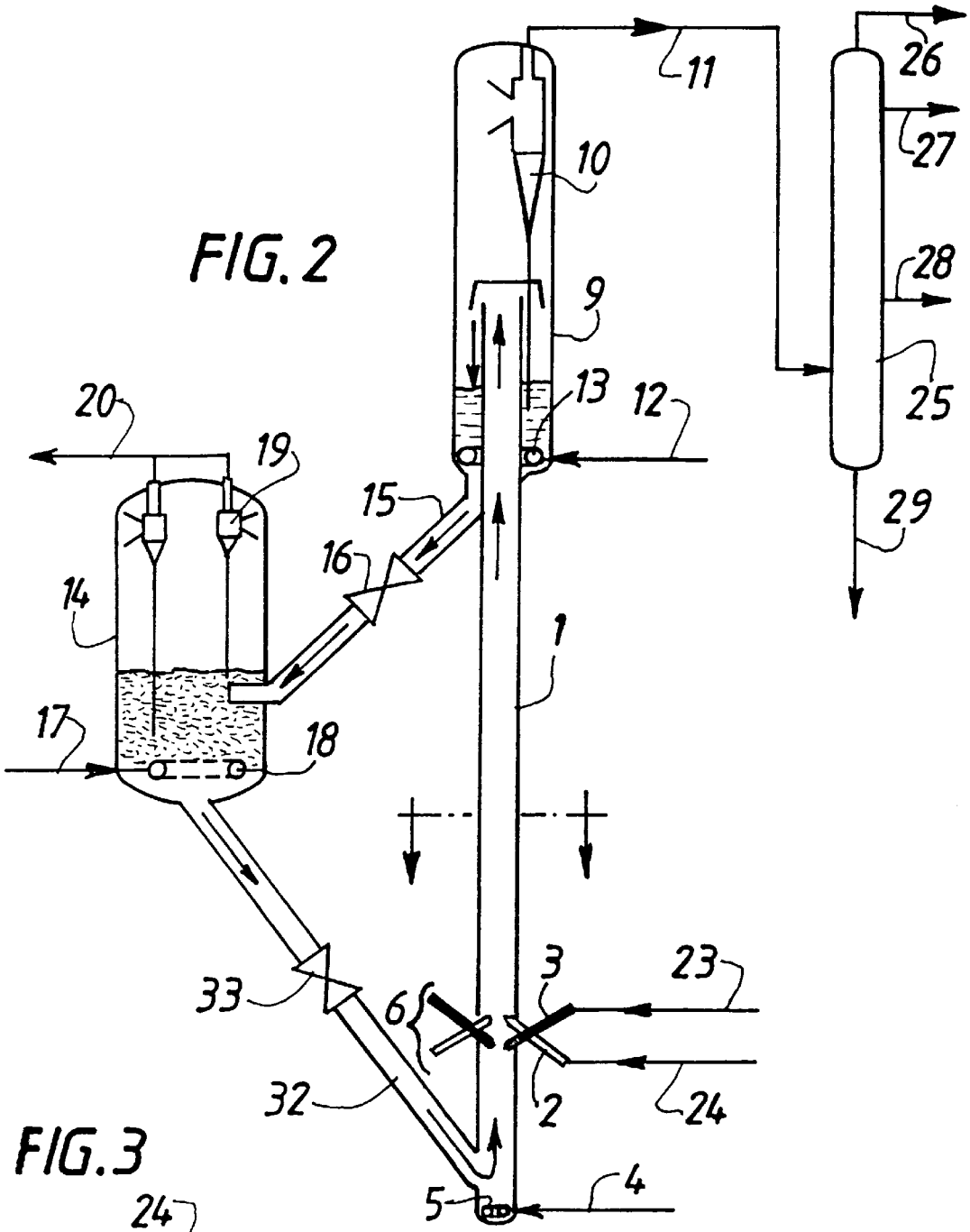
FIG. 2 is a drawing illustrating a form of implementation of the catalytic cracking method according to the invention, in the case of a FCC unit equipped with a reactor whose flow is essentially upward.

FIG. 2 illustrates a form of implementation of the catalytic cracking method in accordance with the invention, in a unit equipped with a reactor whose flow is essentially upward. This unit is a type well known in itself. In particular it contains a reactor in the form of a column 1, called load elevator, or riser, fed at its base by line 32 with catalyst grains regenerated in a specific quantity. An elevating gas, for example water vapor, is introduced into column 1 by line 4, through a diffuser 5.

The load to be cracked is introduced at the level of the injection area 6, which contains injectors pointing against the flow 3 and injectors pointing in the direction of the flow 2. When the unit is started up, only the injectors in the direction of the flow 2 are operational. During permanent operating of the system, either one or the other of the two injector types can be used and, preferably, both will be used simultaneously. The load that is injected against the flow is carried towards the injectors 3 through line 23, whereas the lighter load injected in the direction of the flow is carried to the injectors 3 through line 24.

Figure 3:
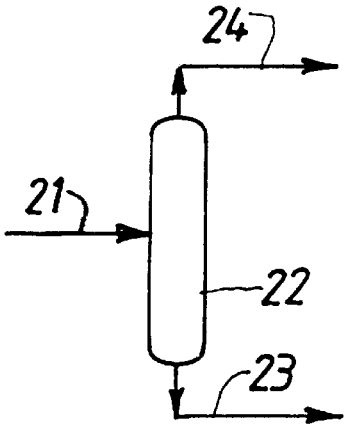
FIG. 3 is a drawing illustrating a primary fractionation of a charge to be cracked, prior to its cracking in the cracking device of FIG. 2.
Figure 4:
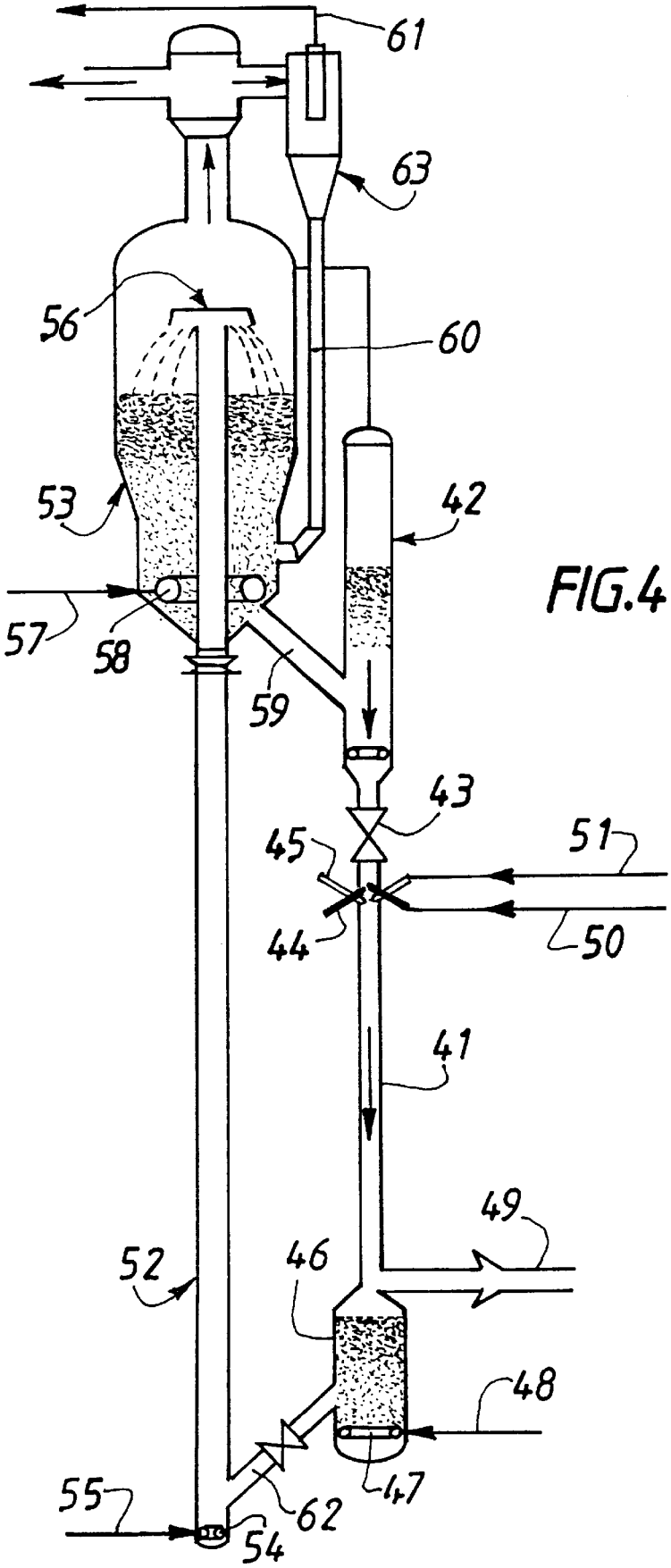
FIG. 4 is a drawing illustrating the application of the method according to the invention in the case of a FCC unit equipped with a reactor whose flow is essentially downward.

Advantageously, a load to be cracked can, prior to its injection in the reactor 1, be subjected to a primary fractionation in a fractionation column, as illustrated by FIG. 3. This load is then introduced by line 21 into column 22, where it is fractionated in two, preferably with a cutting point that corresponds to the mixing temperature in the reactor at the injection area 6 level. The lighter cut, obtained at the top of column 22, is carried by line 24 towards the injectors 2, which makes it possible to introduce it in the direction of the flow in relation to the direction of the catalyst's flow, whereas the heavier cut is carried by line 23 to the injectors 3, which makes it possible to introduce it against the flow in relation to the direction of flow of the catalyst.

Column 1 discharges at its top into a chamber 9 that can be concentric and in which the separation of the load to be cracked and the stripping of the catalyst's deactivated particles take place. The treated load is separated in a cyclone 10, that is located in the chamber 9, at the top of which there is an evacuation line 11 for the cracked load, whereas the deactivated catalyst particles move through gravity toward the base of chamber 9. A line 12 feeds the stripping fluid, usually water vapor, to the injectors or diffusers 13 of the fluidization gas evenly placed at the base of chamber 9.

The deactivated catalyst particles so stripped are evacuated at the base of chamber 9 towards a regenerator 14, through a conduit 15, on which a control valve 16 has been provided. In the regenerator 14, the coke deposited on the catalyst particles is burned using air, injected at the base of the regenerator through a line 17 that feeds the evenly spaced injectors or diffusers 18. The particles of the treated load, carried away by the combustion gas, are separated by cyclones 19 from whence the combustion gas is evacuated by a line 20, whereas the catalyst particles are rejected towards the base of the regenerator 14, where they are recycled for the feeding of the elevator 1 through the conduit 32, equipped with a control valve 33.

The effluents of the reaction are carried by line 11 towards the fractionation column 25, which separates them through distillation, in order to obtain:

- through line 26, gaseous products at normal temperature and pressure conditions (C1 to C4 hydrocarbons);
- through line 27, a gasoline cut, whose boiling ranges can go from 20° C. to around 200–220° C.
- through line 28, a gas oil type cut or LCO, whose boiling range usually goes from 200–220° C. to around 320–360° C.
- an lastly, through line 29, a distillation or slurry residue cut, that contains important quantities of fines and whose boiling range usually goes beyond 500° C.

During permanent operating of the unit, the slurry recuperated by line 29 can, in full or in part, be recycled as a counter-current injected load by injectors 3. It then gets added to the heavy fraction of the fresh load, brought by line 23. It can also be beneficial to first extract a distillate type cut, or HCO (distillation range from 360° C. up to around 440° C.), in order to recycle it, in part or in full, as a load injected in direction of the flow by injectors 2. This fraction is then added to the light fraction of the fresh load, brought by line 24.

The dimensional and operational characteristics of such an apparatus are usually the following:

- height of the reaction part of the elevator 1: 5 to 40 meters,
- total feed rate of the elevator 1 in load(s) to be treated: $10^3$ to 20. $10^3$ tons per day,
- feed rate of the elevator 1 in catalyst: 3 to 50 tons per minute,
- temperature(s) of the loads to be cracked: 70 to 450° C.
- cracking temperature in the elevator, upstream from the injection area: 500 to 600° C.,
- residence time of the load in the elevator 1: 0.1 to 10 seconds,
- regeneration temperature of the catalyst: 600 to 950° C.
- residence time of the catalyst in the regenerator 9: 5 to 20 minutes.

FIG. 3 illustrates the application of the invention in the case of an FCC unit equipped with a reactor whose flow is essentially downward.

The apparatus represented contains a tubular reactor 41 with a downward flow, or "downer", fed in its upper part, from a chamber 42, which is concentric, with regenerated catalyst particles, at a rate controlled by a valve 43. Under this valve, the load to be cracked is introduced according to a apparatus consistent with this invention: counter-current injectors 44, that are preferably reserved for the injection of the heaviest hydrocarbons carried by line 50 and injectors 45, going in the direction of the flow, that are preferably reserved for the injection of the lightest hydrocarbons carried by line 51. The catalyst particles and the hydrocarbons then flow from top to bottom in the reactor 41.

At the base of this reactor, the particles of the used catalyst pour into a stripping chamber 46, fitted with a diffuser 47 at its base, fed with water vapor through line 48.

Also at the base of the reactor 41, above the chamber 46, emerges line 49, through which the cracking products and the hydrocarbons resulting form the stripping are evacuated towards an area where they will be fractionated.

The particles of the stripped catalyst are evacuated by gravity out of the chamber 46, through a slanted conduit 62, toward an upward column 52, in which they are carried toward the top, toward a regenerator 53, with the help of a carrier gas diffused in 54 at the base of the column 52, from line 55.

Column 52 emerges in the regenerator 53 under a ballistic separator 56, that ensures the separation of the particles of catalyst and the carrier gas. The catalyst particles are then regenerated by combustion of the coke that has deposited on their surface, with the help of an air or oxygen stream brought by line 57 to the diffuser 58.

At the upper part of the regenerator 53, the gases resulting from the combustion are evacuated towards the cyclones 63. The catalyst particles that are carried away are recycled by the conduit 60 towards the regenerator, and the gases are evacuated through line 61. As far as the particles of the regenerated catalyst are concerned, they are evacuated, at the base of the regenerator 53, by gravity along conduit 59 in direction of the chamber 42.

The objective of the following example is to illustrate the invention and therefore has no restrictive character.

EXAMPLE

A heavy oil load, consisting of a mixture of distillate under vacuum (60 per cent by weight) and of atmospheric residue (40 per cent by weight), has the following characteristics:

density at 15° C: 0.92

50% distillation point: 476° C.

viscosity at 100° C: 9.3 $10^{-6}$ $m^2/s$

Conradson carbon residue: 2.10 sulfur content: 1.32 per cent by weight basic nitrogen content: 720 ppm nickel content: 2.1 ppm vanadium content: 1.8 ppm Three catalytic cracking tests were completed from this hydrocarbon load, in an experimental catalytic cracking unit containing a "riser" type reactor (such as the one represented in FIG. 2). The catalyst that was used is a classic zeolitic type commercial catalyst.

For the first test, the entire load is injected in the direction of the flow, in relation to the flow of the catalyst.

For the second test, the entire load is injected against the flow, in relation to the flow of the catalyst.

Lastly, the third test is carried out by applying the method consistent with this invention. Before being injected, the load is fractionated in two by flashing, with a fraction point of 420° C. The heaviest fraction is injected against the flow of the catalyst, whereas the lighter fraction is injected with the flow. The counter-current and co-current injectors are identical and are arranged on the same level in the riser.

For the tests, the counter-current injectors make it possible to introduce the load following a direction at a 150 degree angle in relation to the direction of flow of the catalyst grains, whereas the co-current injectors make it possible to introduce the load following a direction at a 30 degree angle in relation to the direction of flow of the catalyst grains. In all cases and configurations, the injectors are of the venturi type.

The operational conditions of these tests and the results obtained are entered in the following table:

| | Test No 1 | Test No 2 | Test No 3 |
|---|---|---|---|
| Number of counter-current injectors | 0 | 6 | 3 |
| Number of co-current injectors | 6 | 0 | 3 |
| Introduction temperature of the catalyst at the bottom of the riser | 743 | 748 | 740 |
| Injection temperature of the load introduced against the flow | — | 320 | 325 |
| Injection temperature of the load introduced in the direction of the flow | 320 | — | 318 |
| Measured mixing temperature | 582 | 571 | 565 |
| Reaction temperature (upstream from the injection area) | 522 | 522 | 522 |
| Yield in dry gases (percent by weight) | 3.22 | 3.15 | 2.80 |
| Yield in GPL (percent by weight) | 13.54 | 16.32 | 14.47 |
| Yield in gasolines (percent by weight) | 45.38 | 47.60 | 48.90 |
| Yield in LCO (percent by weight) | 18.00 | 17.50 | 18.52 |
| Yield in slurry (percent by weight) | 15.64 | 10.71 | 8.19 |
| Yield in coke (percent by weight) | 4.22 | 4.72 | 4.12 |
| Standard conversion | 66.36 | 71.79 | 73.29 |

This table shows that the configuration with a dual injection consistent with the invention (test 3) makes it possible to obtain excellent results for the conversion of heavy loads, better than those obtained through the conventional methods (tests 1 and 2).

Indeed, in test 3, the mixing temperature is much closer to its ideal theoretical value of 563° C. This is translated by more appropriate vaporization conditions of the load to be cracked.

Furthermore, the results given above show that the dual injection induces noticeable progress as far as the yields of the obtained products are concerned.

In general, we notice an increase of the standard conversion yield in relation to the test where the injection is carried out entirely against or entirely with the flow.

Furthermore, we also notice a decrease of the coke production as well as a net decrease of the production of dry gases. Thanks to the selective vaporization conditions, we can better avoid the overcracking of the load and the overcoking of the catalyst. Therefore, these new reaction conditions lead to a better selectivity of conversion. Indeed, we notice an increase of the yields in the desired intermediary products which are the GPL and mostly, the gasolines and the LCO. At the same time, we notice a considerable decrease in the slurry yield, which is an undeniable advantage, especially since the heavy residue is not very amenable to beneficiation.

The same three types of tests were also completed with a more traditional catalytic cracking load, of the distillate type under vacuum, with the following characteristics:

density: 0.911

50% distillation point: 417° C.

viscosity at 100° C.: 5.87 $10^{-6}$ $m^2/s$

Conradson carbon residue: 0.17 sulfur content: 0.934 percent by weight basic nitrogen content: 390 ppm nickel content: 1.1 ppm vanadium content: 1.01 ppm The operational conditions of these tests and the results obtained are entered in the following table:

| | Test No 1 | Test No 2 | Test No 3 |
|---|---|---|---|
| Number of counter-current injectors | 0 | 6 | 3 |
| Number of co-current injectors | 6 | 0 | 3 |
| Introduction temperature of the catalyst at the bottom of the riser | 738 | 738 | 738 |
| Injection temperature of the load introduced against the flow | — | 250 | 258 |
| Injection temperature of the load introduced in the direction of the flow | 250 | — | 248 |
| Measured mixing temperature | 569 | 558 | 551 |
| Reaction temperature (upstream from the injection area) | 530 | 530 | 530 |
| Yield in dry gases (percent by weight) | 3.37 | 3.30 | 2.85 |
| Yield in GPL (percent by weight) | 17.24 | 18.05 | 18.85 |
| Yield in gasolines (percent by weight) | 45.09 | 48.32 | 49.27 |
| Yield in LCO (percent by weight) | 19.39 | 18.62 | 18.93 |
| Yield in slurry (percent by weight) | 7.17 | 6.47 | 5.56 |
| Yield in coke (percent by weight) | 4.74 | 5.24 | 4.54 |
| Standard conversion | 73.44 | 74.91 | 75.51 |

Here, once again, we find in test 3, although a little less noticeable, the advantageous characteristics observed with the previous very heavy load: more appropriate mixing temperature, increase of the standard conversion yield, overall decrease of the "sub-products" (dry gases, coke and mostly slurry), better selectivity of the conversion in favor of the desired intermediary products (GPL, gasolines and LCO).

Thus, even in the case of a catalytic cracking traditional load, the method consistent with the invention is a source of undeniable improvements.

What is claimed is:

1. A hydrocarbon catalytic cracking method in the presence of a catalyst in a fluidized phase, in a tubular reactor whose flow is essentially upward (1) or downward (41), and having an injection area for a first and a second load to be cracked, said method comprising the steps of:

a) injecting a substantial portion of the first load into the injection area against the flow in relation to the direction of flow of catalyst grains, and b) simultaneously, injecting a substantial portion of the second load into the same injection area in the same direction of flow in relation to the flow of the catalyst grains;

wherein, said first and second loads are the same or different.

2. The method as set forth in claim 1, wherein the first load, injected against the flow, contains heavy hydrocarbons and the second load, injected with the flow, is of a lighter nature.

3. The method as set forth in claim 1, wherein the first load, injected against the flow of catalyst grains, contains a considerable amount of compounds whose boiling point is greater than or equal to the mixing temperature.

4. The method as set forth claim 1, wherein the first load injected against the flow contains fractions that normally boil up to 700° C. and above, that can contain high contents of asphaltenes and have a Conradson carbon content reaching as much as 4 percent by weight or and more.

5. The method as set forth in claim 1, wherein the second load injected in the direction of the flow contains a considerable amount of compounds whose boiling point is less than or equal to the mixing temperature.

6. The method as set forth in claim 1, wherein the second load injected in the direction of the flow contains oil fractions.

7. The method as set forth in claim 1, wherein the load to be cracked is subjected to a primary fractionation, preferably with a fraction point that corresponds with the mixing temperature in the cracking reactor (1, 41), with the heaviest fraction being injected against the flow, whereas the lightest fraction is injected in the direction of the flow.

8. The method as set forth in claim 1, wherein the first load injected against the flow contains recycle residues, alone or mixed with the load.

9. The method as set forth in claim 1, wherein the second load injected in the direction of the flow contains recycle fractions, alone or mixed with the load.

10. A start up method of a hydrocarbon catalytic cracking unit in the presence of a catalyst in fluidized phase, in a tubular reactor (1, 41), whose flow is essentially upward or downward, wherein upon start up of the unit, said method comprises:

injecting a first load going in the direction of the catalytic phase flow followed by injecting a second load going against the flow, while simultaneously maintaining the injection going with the flow, optionally with a progressive reduction of said first flow's rate.

11. The method as set forth in claim 4, wherein said first load containing fractions is selected from the group consisting of heavy distillates, atmospheric distillation residues and residues of distillation under vacuum.

12. The method as set forth in claim 4, wherein said first load containing fractions was subjected to hydrotreatment.

13. The method as set forth in claim 6, wherein said second load containing oil fractions is selected from the group consisting of distillate and/or gas oils resulting from a distillation under vacuum, viscosity breaking distillates and/or gas oils, and deasphalted residue or gas oils resulting from atmospheric distillation.

14. The method according to claim 8 wherein said recycle residues are slurries.

15. The method according to claim 9, wherein said recycle fractions are HCO or LCO.

* * * * *